US010076197B2

(12) United States Patent
Montanari

(10) Patent No.: US 10,076,197 B2
(45) Date of Patent: Sep. 18, 2018

(54) BABY BLANKET WITH ATTACHED BURP CLOTH

(71) Applicant: Abbra-Chio Baby Company, LLC, Knoxville, TN (US)

(72) Inventor: Lisa Montanari, Knoxville, TN (US)

( * ) Notice: Subject to any disclaimer, the term of this patent is extended or adjusted under 35 U.S.C. 154(b) by 12 days.

(21) Appl. No.: 15/266,228

(22) Filed: Sep. 15, 2016

(65) Prior Publication Data

US 2017/0079338 A1 Mar. 23, 2017

Related U.S. Application Data

(60) Provisional application No. 62/219,976, filed on Sep. 17, 2015.

(51) Int. Cl.

| | |
|---|---|
| ***A41B 13/06*** | (2006.01) |
| ***A47G 9/02*** | (2006.01) |
| ***A42B 1/24*** | (2006.01) |
| *A41B 13/00* | (2006.01) |

(52) U.S. Cl.

CPC ..... *A47G 9/0223* (2013.01); *A41B 13/06* (2013.01); *A42B 1/24* (2013.01); *A41B 2300/32* (2013.01); *A41B 2300/33* (2013.01)

(58) Field of Classification Search

CPC ..... A41B 13/06; A41B 13/10; A41B 13/00; A41B 13/005; A41D 15/04; A41D 1/205; A41D 10/00; A41D 11/00; A41D 15/00; A47D 15/003; A47G 9/0223; A47G 9/04; A47G 9/068; A47G 9/083

See application file for complete search history.

(56) References Cited

U.S. PATENT DOCUMENTS

| | | | | | |
|---|---|---|---|---|---|
| 2,078,022 | A * | 4/1937 | Roemer | A63F 9/088 | 446/227 |
| 2,451,807 | A | 10/1948 | Catizone | | |
| 2,727,242 | A * | 12/1955 | Pascal | A47D 15/003 | 2/69 |
| 3,308,479 | A * | 3/1967 | Sesco, Jr. | A41B 13/10 | 2/50 |
| 4,712,251 | A | 12/1987 | Cobble | | |
| 5,042,090 | A * | 8/1991 | Cook | A41B 13/06 | 2/104 |
| 5,129,406 | A | 7/1992 | Magnusen | | |
| 5,131,096 | A * | 7/1992 | Olson | A41D 11/00 | 2/69 |

(Continued)

FOREIGN PATENT DOCUMENTS

| | | |
|---|---|---|
| AU | 200167938 | 1/2002 |
| AU | 2002336509 | 10/2005 |

(Continued)

*Primary Examiner* — Bobby Muromoto, Jr.

(74) *Attorney, Agent, or Firm* — Pitts & Lake, P.C.

(57) ABSTRACT

A baby blanket for keeping a baby warm and having a detachable burp cloth. The present baby blanket preserves a baby's body heat, thereby keeping the baby warm, yet allows for non-confining, natural movement of the baby's arms and hands. Further, the present blanket of the present invention includes a detachable burping cloth, and, in one embodiment, includes a coordinating cap, sometimes referred to as a beanie or toboggan, that includes a strap for securing a pacifier to the cap. The blanket conforms to the infant's body providing warmth and comfort for the baby and peace of mind for the mom.

11 Claims, 9 Drawing Sheets

(56) References Cited

U.S. PATENT DOCUMENTS

| | | | | |
|---|---|---|---|---|
| 5,344,355 | A | 9/1994 | Silverstein | |
| 5,950,888 | A | 9/1999 | Nolan Brown | |
| 5,956,762 | A | 9/1999 | Adams | |
| 5,996,152 | A | 12/1999 | Wilson | |
| 6,009,576 | A | 1/2000 | Gramme | |
| 6,145,932 | A | 11/2000 | Hamel Nyhus | |
| 6,513,164 | B1 * | 2/2003 | Hearns | A41B 13/06 2/69.5 |
| 6,839,924 | B2 | 1/2005 | Sims | |
| 6,928,674 | B2 | 8/2005 | Blackburn | |
| 7,076,819 | B2 | 7/2006 | Trani | |
| 7,111,344 | B2 | 9/2006 | French | |
| 7,246,392 | B2 | 7/2007 | Schmid | |
| 7,587,769 | B1 | 9/2009 | McDermott | |
| 7,673,354 | B2 | 3/2010 | Fader | |
| 7,774,875 | B1 | 8/2010 | Zeidman | |
| 7,805,771 | B2 | 10/2010 | Ekelund | |
| D627,951 | S | 11/2010 | Chesal | |
| 8,312,565 | B1 | 11/2012 | Alperin | |
| 8,518,004 | B2 | 8/2013 | Betts | |
| 8,539,620 | B1 | 9/2013 | Wynh | |
| D701,678 | S | 4/2014 | Burnett | |
| 9,282,778 | B1 * | 3/2016 | Ingram | A42B 1/24 |
| 2003/0159193 | A1 * | 8/2003 | LeFevre | A47G 9/0223 2/69.5 |
| 2004/0139527 | A1 * | 7/2004 | Damir | A41B 13/06 2/83 |
| 2004/0244153 | A1 | 12/2004 | Lippincott | |
| 2006/0081487 | A1 * | 4/2006 | Hoelzle | A45C 3/00 206/223 |
| 2006/0085916 | A1 * | 4/2006 | Smith | A47D 5/006 5/655 |
| 2006/0206985 | A1 | 9/2006 | Proctor | |
| 2008/0120774 | A1 | 5/2008 | Hite | |
| 2009/0013449 | A1 | 1/2009 | Kahn | |
| 2012/0023637 | A1 | 2/2012 | Neveu | |
| 2013/0302555 | A1 * | 11/2013 | Dunn | A41B 13/06 428/78 |
| 2016/0255886 | A1 * | 9/2016 | Arzu | A41B 13/06 |
| 2017/0150761 | A1 * | 6/2017 | Klatt | A41B 13/06 |

FOREIGN PATENT DOCUMENTS

| | | |
|---|---|---|
| CA | 2433117 | 12/2004 |
| CA | 2123480 | 1/2005 |
| CA | 2495237 | 10/2008 |
| DE | 202004020461 | 8/2005 |
| DE | 202008010487 | 11/2008 |
| DE | 60334463 | 11/2010 |
| EP | 1538934 | 6/2005 |
| EP | 2448438 | 5/2012 |
| WO | WO0200048 | 1/2002 |
| WO | WO2005034658 | 2/2007 |
| WO | WO2010015394 | 2/2010 |
| WO | WO2012142210 | 12/2012 |
| WO | WO2013013675 | 1/2013 |

* cited by examiner

BABY BLANKET WITH ATTACHED BURP CLOTH

CROSS-REFERENCE TO RELATED APPLICATIONS

This application claims the benefit of U.S. Provisional Patent Application No. 62/219,976, filed on Sep. 17, 2015, which is incorporated herein in its entirety by reference.

STATEMENT REGARDING FEDERALLY SPONSORED RESEARCH OR DEVELOPMENT

Not Applicable

BACKGROUND OF THE INVENTION

1. Field of Invention

The invention relates to an article of baby clothing with attached accessories. More particularly, it relates to a baby blanket adapted to be used in conjunction with an attached burp cloth. Further, in one embodiment, the blanket could be part of an outfit which further includes a cap with an attached pacifier.

2. Description of the Related Art

In the art of infant care, it is known to wrap an infant with a blanket in order to, among other things, keep the infant warm; and it is also known to use what is colloquially referred to as a burp cloth. Burp cloths are commonly placed on the caregiver's shoulder while an infant, commonly one that has been recently fed, is burped. Further, caregivers, especially mothers, know that it is wise to keep a burp cloth at the ready at all times because infants are known to spit up at times other than when being burped. What is missing in the art is an infant accessory that combines the positive effects of wrapping an infant with a blanket and the convenience of having a burp cloth at the ready.

BRIEF SUMMARY OF THE INVENTION

The baby blanket of the present invention provides a blanket that creates warmth for the baby at all times. The baby blanket of the present invention does not encumber the infant's arms and hands and, thus, supports the infant's ability to self-console by bringing his or her hands to its face and mouth. The palms of the hands and the area around the mouth are very sensitive and potent sources of stimulation. Rather than deprive the infant of this access as most presently known swaddling blankets do, the baby blanket of the present invention supports it. The baby blanket of the present invention is designed for infants, newborn to 6 months, and incorporates a burping cloth. The present baby blanket provides a means to keep the infant warm, yet allows for non-confining, natural movement. Further in one embodiment, the present baby blanket can be combined with a traditional infant onesie, in a mix and match fashion, such that the blanket is adapted to be secured to the onesie in a non-intrusive way and further includes a detachable burping cloth. Additionally, in still a further embodiment, the infant blanket is adapted into a kit, or ensemble, that includes a coordinating cap, sometimes referred to as a beanie or toboggan, that includes a strap for securing a pacifier to the cap. The blanket conforms to the infant's body providing warmth and comfort for the baby and peace of mind for the mom.

BRIEF DESCRIPTION OF THE SEVERAL VIEWS OF THE DRAWINGS

The above-mentioned features of the invention will become more clearly understood from the following detailed description of the invention read together with the drawings in which:

FIG. 7B representing the view after the second step of folding has been completed. In FIGS. 7A and 7B, the straps and the burp cloth are not shown for clarity of view;

DETAILED DESCRIPTION OF THE INVENTION

Figure 7B:
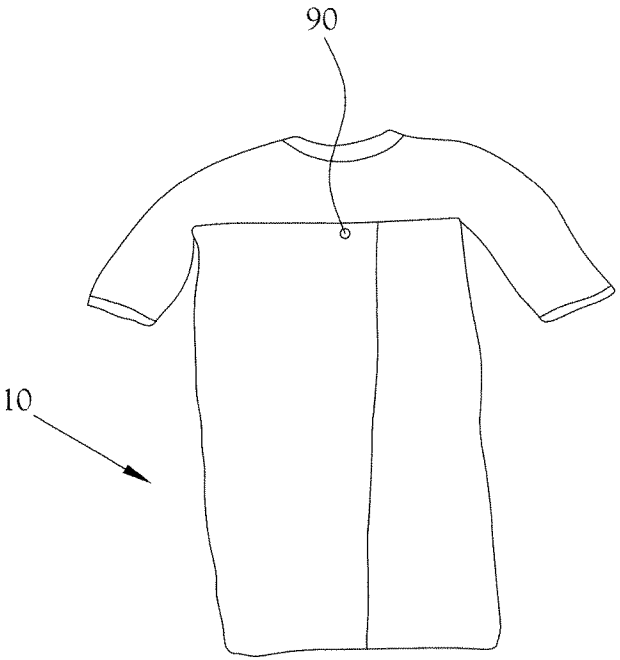
FIGS. 7A and 7B are plan views of the blanket illustrated in FIG. 1, with FIG. 7A representing the view after the first step of folding the blanket has been completed.
Figure 7A:
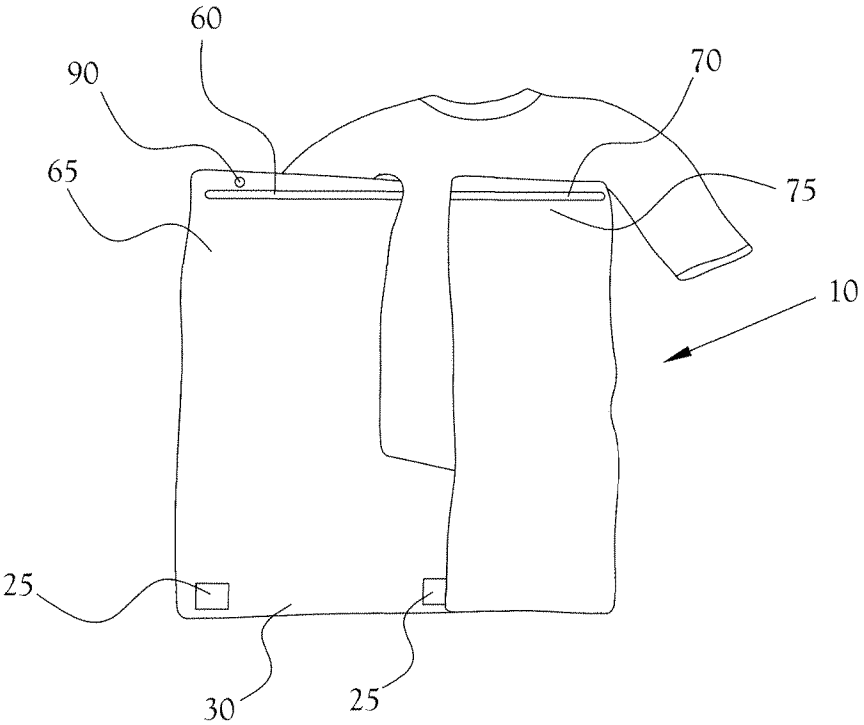
Figure 8:
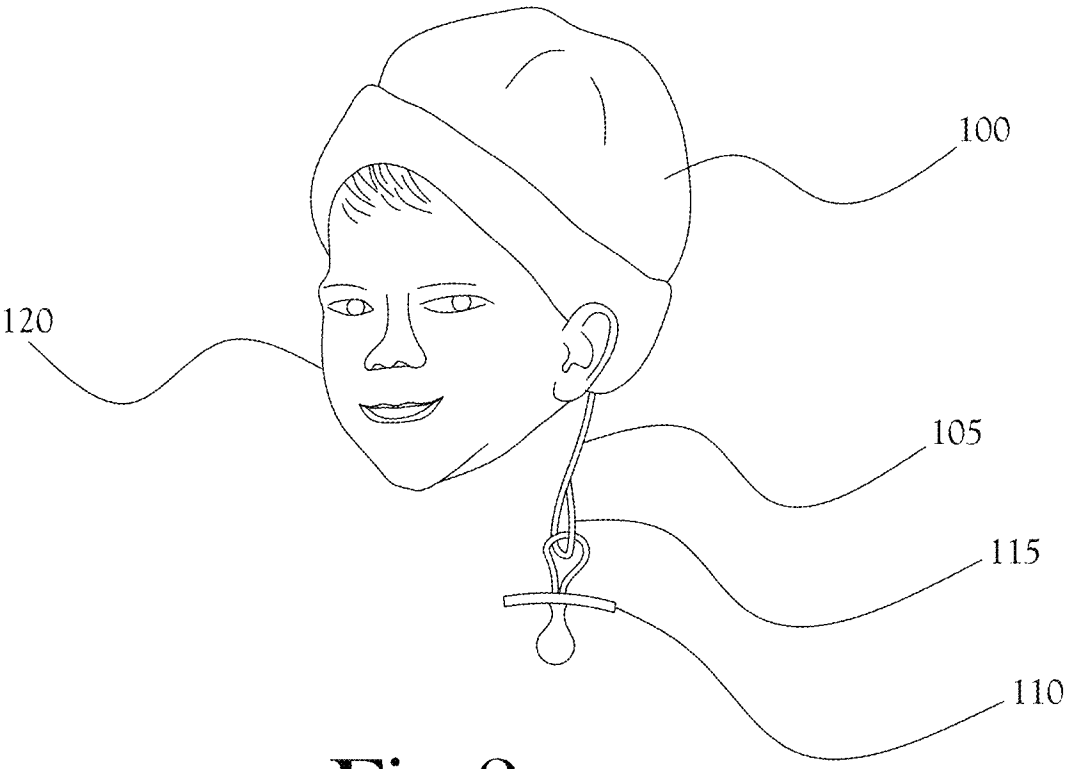
FIG. 8 is perspective view of the cap with the attached pacifier of the present invention.
Figure 9B:
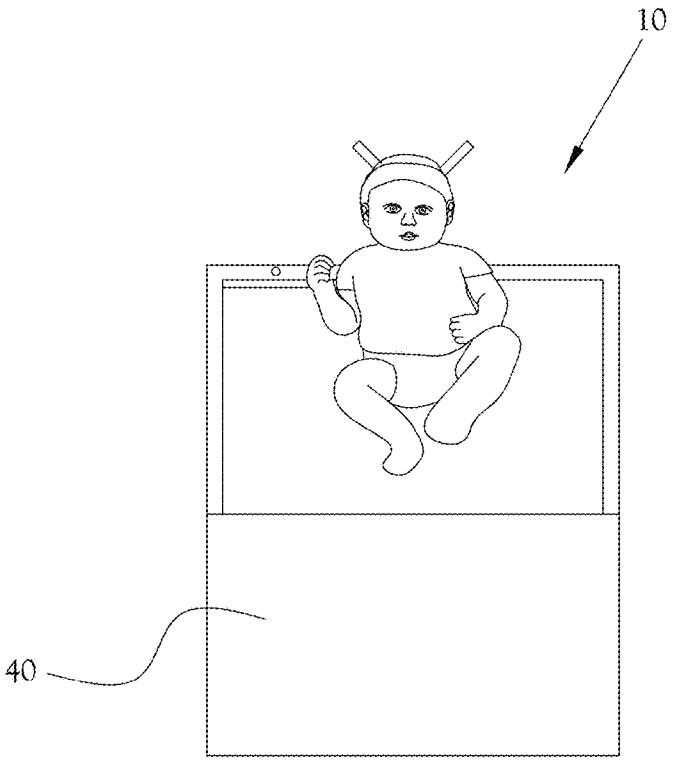
FIGS. 9A-9I are perspective views of the steps of placing the blanket on an infant.
Figure 9A:
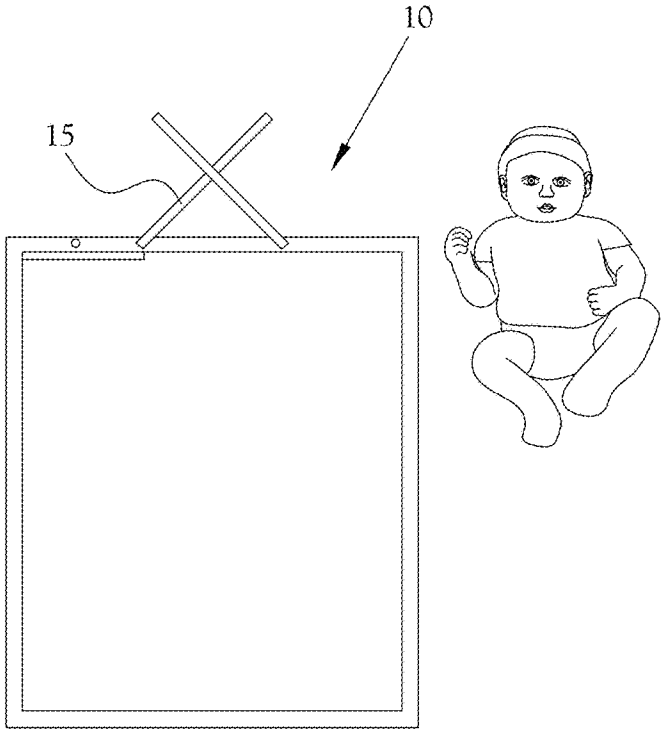
Figure 9D:
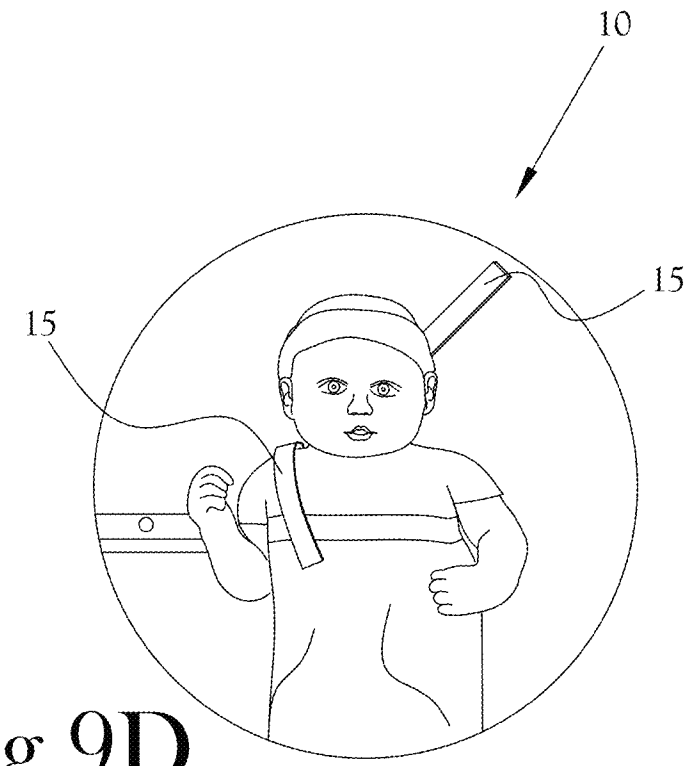
Figure 9C:
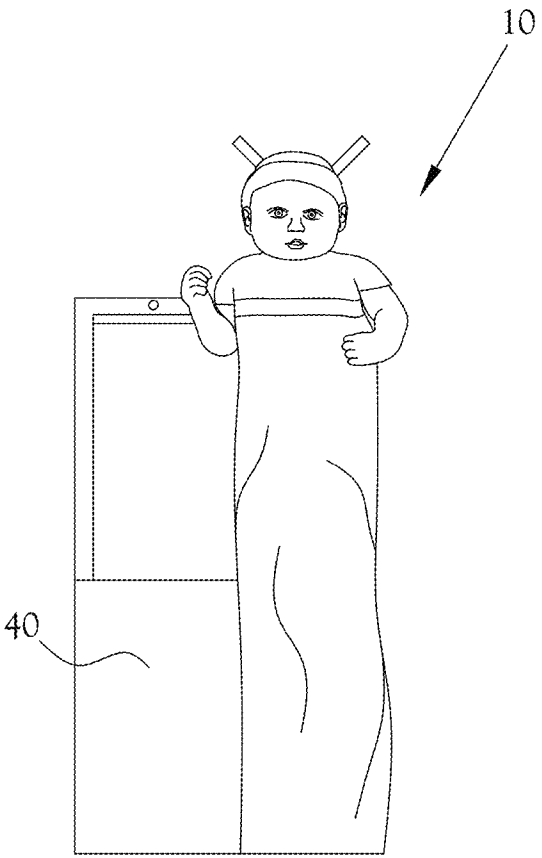
Figure 9F:
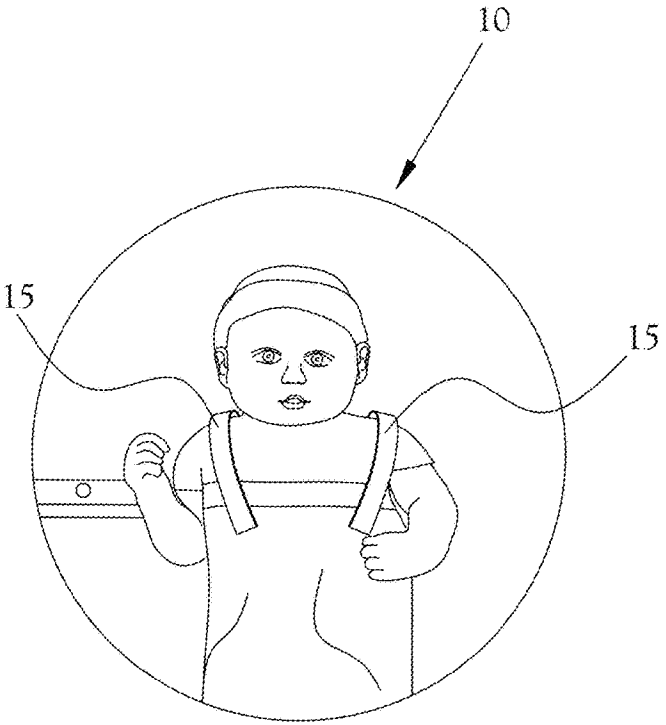
Figure 9E:
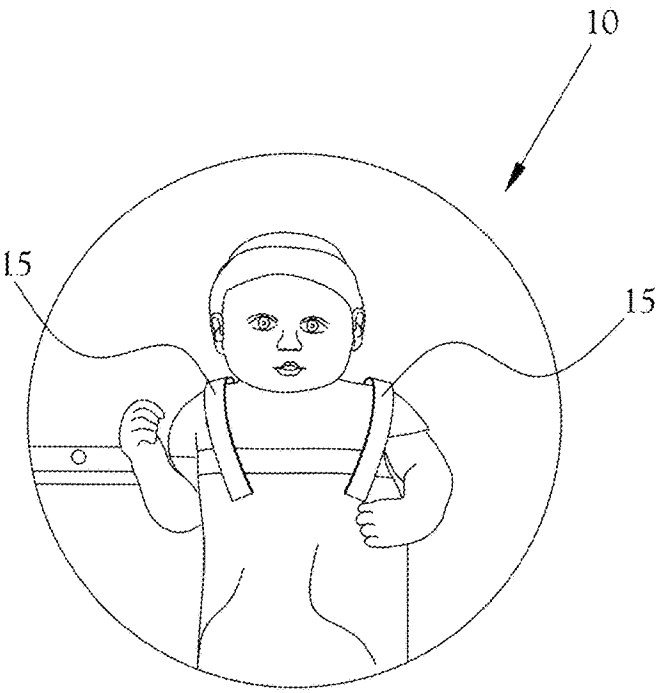
Figure 9I:
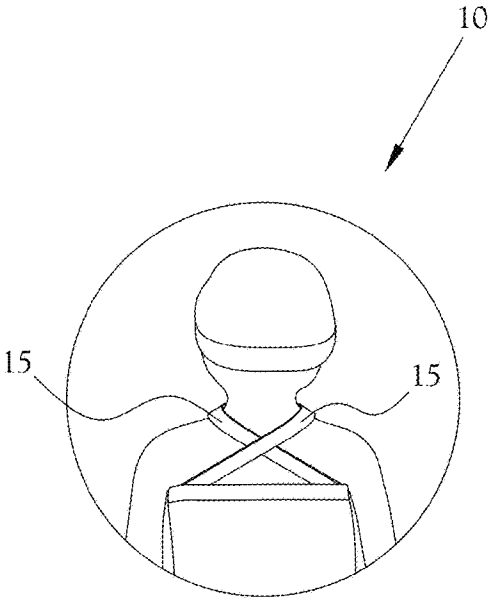
Figure 9H:
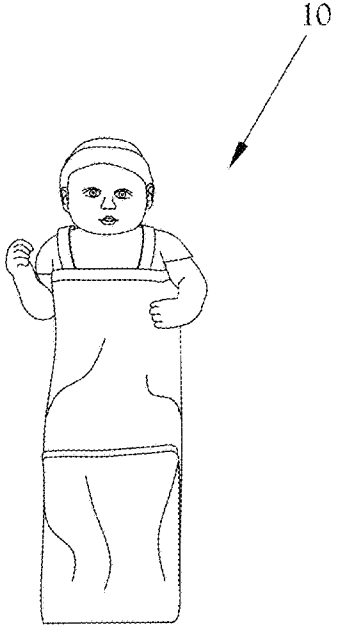
Figure 9G:
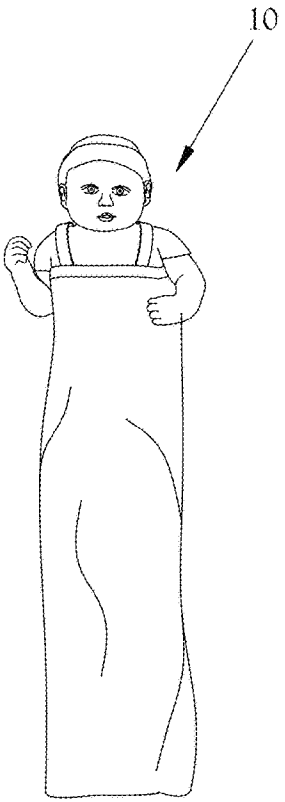

The blanket 10 of the present invention can be utilized with a traditional onesie with hand covers. In this regard, the blanket 10 can be secured to a onesie that has been modified with selectively placed snaps thereby providing a combined onesie garment with a snap-on blanket in a variety of fabrics and styles. However, in the preferred embodiment, the blanket 10 is provided with straps that can be worn over the baby's shoulders in the manner of suspenders or galluses. In the preferred embodiment, the upper edge of the blanket 10 is disposed just under the baby's arms so the baby can move its arms and hands freely and maintain motor control. The blanket 10 and the attached burp cloth 40 folds along its length, as illustrated in FIGS. 7A and 7B, and as further illustrated in FIG. 9A-9I, around the baby so as to stay away from the baby's face such that it is wrapped around the lower part of the baby's body. The attached figures illustrate a preferred embodiment of the baby blanket 10 with a detachable burp cloth 40 of the present invention. The following represent the features of the present baby blanket. In one embodiment, illustrated in FIGS. 1-6, blanket 10 includes straps 15 adapted to be worn over the baby's shoulders, in the style of suspenders or galluses, such that the blanket 10 is worn over an existing outfit. The straps 15 are worn over the baby's shoulders, as seen in FIGS. 9B-9D, and are secured to the blanket 10 using infant-approved hook and loop type fasteners. Use of infant approved hook and loop fasteners allows the blanket 10 and the straps to be adjustable so as to grow with the baby. Further, as seen in FIGS. 9A-9I, the blanket 10 folds up and snaps into a bunting position for outside use to keep the baby warm.

The blanket 10 is, preferably rectangular in shape, having, preferably, its length extend along the length of the baby's torso and legs. A plurality of hook and loop type fasteners 25, as are commonly known in the art by the brand name Velcro®, are provided along the bottom edge 30 of the inside of the blanket 10, see e.g. FIGS. 1, 3, and 4. This allows attachment of the burp cloth 40 which includes a corresponding plurality of hook and loop type fasteners 45. See FIG. 4. This allows the burp cloth 40 to be detachably secured to the inside of blanket 10.

A segment of "hook" fastener 60 is disposed at the upper right inside edge 65 (i.e. the baby's right side if positioned behind the baby) of the inside of the blanket 10. See FIG. 1. A corresponding segment of "loop" fastener 70 is disposed at the upper left edge 75 of the outside of the blanket 10 (as viewed in the Figures; the baby's left side if positioned behind the baby). This preferred arrangement of the upper hook and loop fasteners 60 and 70 allows the left side of the blanket 10 (from the baby's perspective) to be folded in front of the infant as seen in FIG. 7A. Then, the right side of the blanket, (again, from the baby's perspective) is folded over the blanket 10 and the hook and loop fasters 60 and 70 secure the blanket 10 in the folded position seen in FIG. 7B.

If desired, the bottom of the blanket 10 can be folded up and secured to the upper edge of the folded blanket. In this regard, in the preferred embodiment, a male snap 85 is provided proximate the midpoint along the inside bottom edge of the blanket 10. A corresponding female snap 90 is located at the top of the blanket 10 on the inside left proximate the edge of the blanket 10. In the preferred embodiment, the male snap 85 is disposed on the inside of the blanket 10 and the female receiving side of snap 90 is disposed on the outside of the blanket 10 such that when the blanket 10 is folded, the male snap 85 can snap into the female snap 90. Of course, it will be appreciated that male snap 85 and female snap 90 should be sewn into the fabric of blanket 10 so as not to be uncomfortable to the baby and so as not to be a choking hazard. Of course, it will be further appreciated by those skilled in the art that snaps 85 and 90 could be replaced with corresponding portions of hook and loop fastener or other types of releasable securing devices, known in the clothing and textile arts, for example a button and corresponding button hole, could also be utilized to secure the blanket 10 in this folded position.

Figure 2:
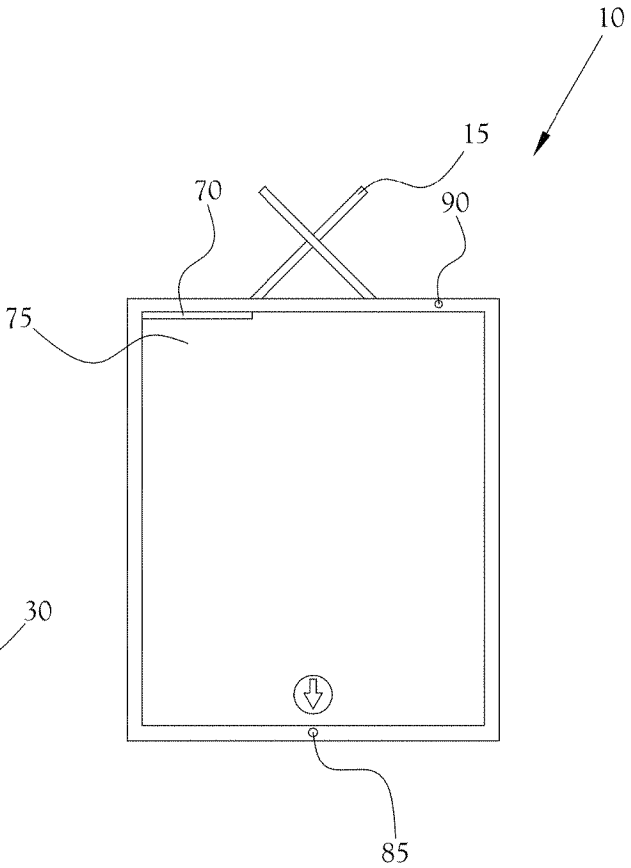
FIG. 2 is an outside plan view of the blanket illustrated in FIG. 1.
Figure 1:
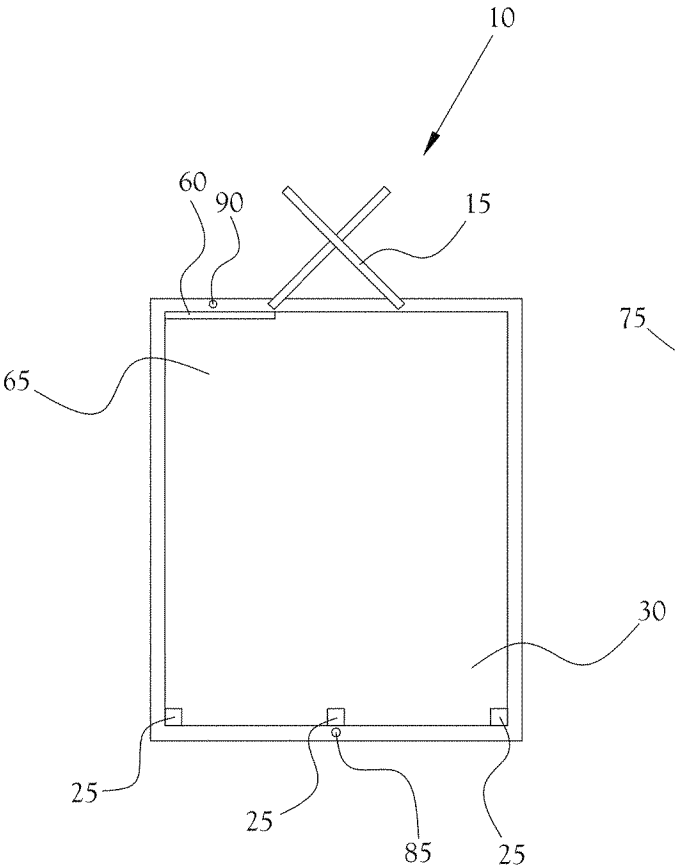
FIG. 1 is an inside plan view of the blanket of the present invention showing the preferred points of attachment for the attachable burp cloth.
Figure 4:
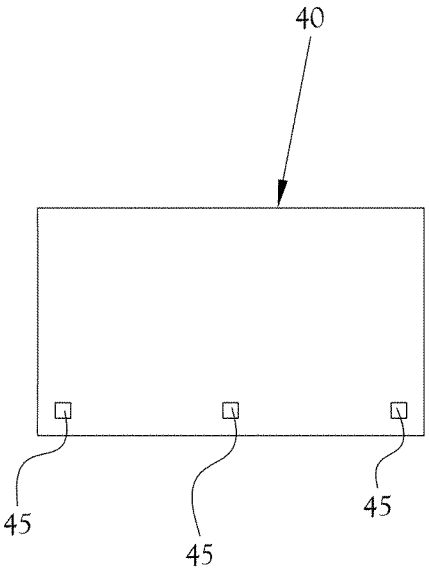
FIG. 4 is an inside plan view of the attachable burp cloth of the present invention.
Figure 3:
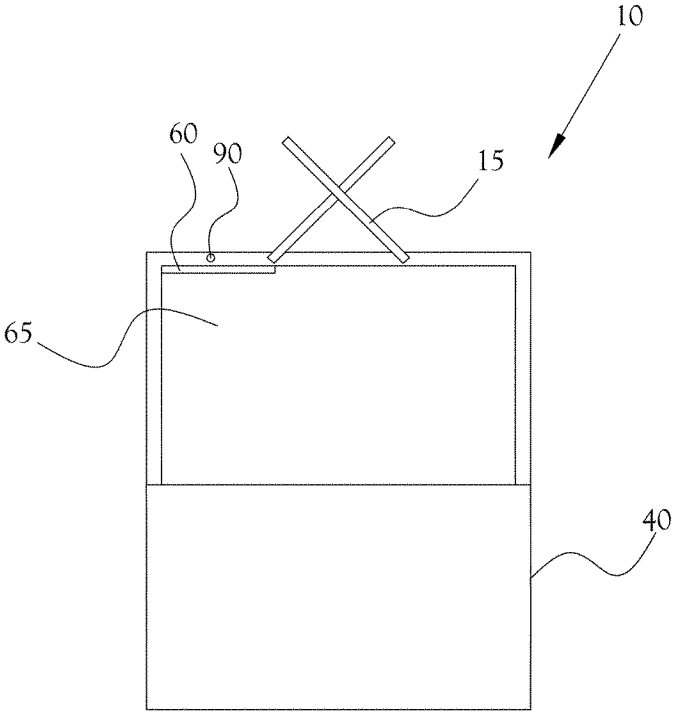
FIG. 3 is an inside plan view of the blanket illustrated in FIG. 1 with the attachable burp cloth attached thereto.
Figure 6:
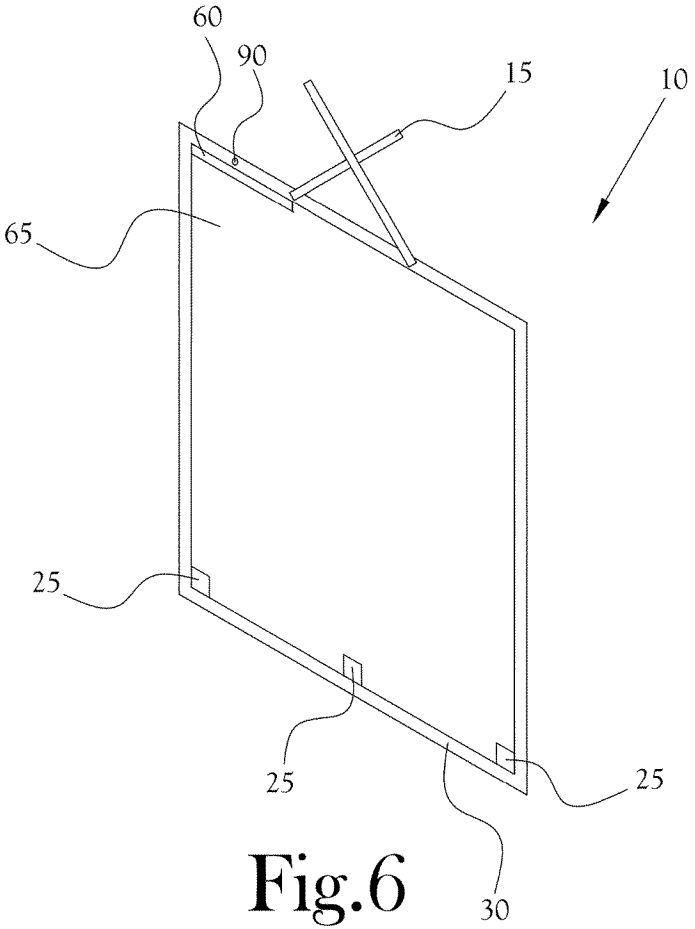
FIG. 6 is an inside perspective view of the blanket illustrated in FIG. 1.
Figure 5:
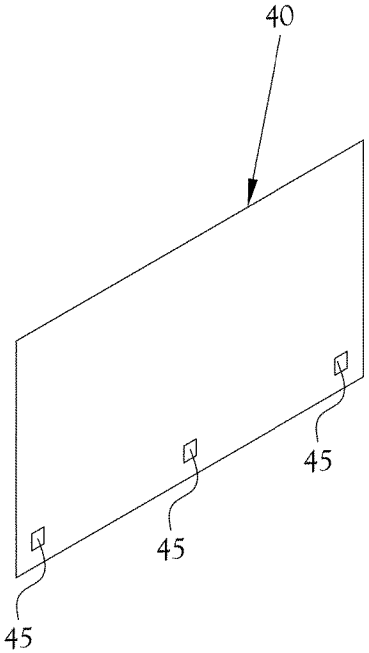
FIG. 5 is an inside perspective view of the attachable burp cloth illustrated in FIG. 4.

FIG. 4 illustrates the preferred burp cloth 40; and FIG. 3 illustrates the burp cloth 40 detachably secured to the blanket 10. It will be appreciated by those skilled in the art that in an alternate embodiment, not illustrated, other types of fasteners, rather than the hook and loop type fasteners described herein, such as plastic or metal snaps, could be utilized to secure the blanket 10 to itself when wrapped and/or to secure the burp cloth 40 to the blanket. Further, the blanket, in still a further alternate embodiment, could be adapted to be secured to an "onesie" type baby outfit. The blanket 10 of the present invention keeps the baby covered all day and night when needed, substantially eliminating the opportunity for the baby to become uncovered which would leave the baby exposed and cold. Blanket 10 of the present invention further allows the baby to be picked up without the blanket 10 falling off and leaving the baby exposed. Mix and match burp cloths can easily be switched when soiled, keeping baby comfortable at all times.

FIG. 13 illustrates the cap 100 with an attached pacifier 110 of the present invention. In this regard, a cap 100, which can be of the type commonly referred to as a beanie or a toboggan, is of a size selected to be worn by a baby 120. A strap 105 is secured to a side of the cap 100. The distal end of the strap 115 is adapted to secure a pacifier 110. In this regard, when the baby 120 is not suckling the pacifier 110, it can hang to the side within reach of the baby 120. In the preferred embodiment, the strap 105 is substantially non-elastic. Preferably, the length of the strap 105 is selected such that the pacifier 110 hangs to just below the baby's chin. This length keeps the pacifier 110 in the baby's reach but substantially prevents the strap 105 from wrapping around the baby's throat so as to pose a strangulation hazard.

While the present invention has been illustrated by description of several embodiments and while the illustrative embodiments have been described in detail, it is not the intention of the applicant to restrict or in any way limit the scope of the appended claims to such detail. Additional modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

Having thus described the aforementioned invention, what is claimed is:

1. A kit for accessorizing an outfit worn by an infant, said kit comprising:

a substantially rectangular cloth blanket adapted for wrapping around an infant, said blanket comprising a selected length, a right side, a left side, and a bottom portion, wherein said left side of said blanket is adapted to be folded in front of the infant and said right side is adapted to be folded over such that said right and left side overlap in front of said infant, said blanket further including fasteners to secure said blanket in a folded position;

straps secured to said blanket by fasteners, said straps adapted to be worn over the baby's shoulders, wherein said straps define suspenders; and a burp cloth removably attached to a selected portion along a bottom inside edge of said blanket by a fastener.

2. The kit of claim 1 wherein said fasteners are defined by selectively positioned cooperating portions of hook and loop fastener material.

3. The kit of claim 1 wherein said fasteners are defined by selectively positioned cooperating snap members.

4. The kit of claim 1 wherein said kit further includes a cap to be worn by the infant, said cap including a single, non-elastic strap secured to a portion of said cap, said non-elastic strap having a distal end, and a pacifier member carried by said distal end of said non-elastic strap, wherein said non-elastic strap is adapted to secure said pacifier member to said cap such that said pacifier member can hang within reach of the baby, said non-elastic strap having a length selected such that the pacifier member hangs proximate a point just below the baby's chin, wherein said length is adapted to keep said pacifier member within the baby's reach but substantially preventing said non-elastic strap from wrapping around the baby's throat so as to prevent a strangulation hazard.

5. A kit for accessorizing an outfit worn by an infant, said kit comprising:

a substantially rectangular cloth blanket adapted for wrapping around an infant, said blanket comprising a selected length, a right side, a left side, and a bottom portion, wherein said left side of said blanket is adapted to be folded in front of the infant and said right side is adapted to be folded over such that said right and left side overlap in front of said infant, said blanket further including fasteners to secure said blanket in a folded position, wherein said blanket further comprises a first securement member disposed at proximate a midpoint along an inside bottom edge of said blanket and a second securement member adapted to cooperate with said first securement member and disposed at a top of said blanket on an inside left proximate the edge of said blanket whereby said bottom portion of said blanket can be folded up and secured to the upper edge of said blanket when in a folded position;

a burp cloth removably attached to a selected portion along a bottom inside edge of said blanket by a fastener;

straps secured to said blanket by fasteners, said straps adapted to be worn over the baby's shoulders, wherein said straps define suspenders;

a cap to be worn by the infant;

a single, non-elastic strap secured to a portion of said cap, said strap having a distal end; and a pacifier member carried by said distal end of said strap, wherein said non-elastic strap is adapted to secure said pacifier member to said cap such that said pacifier member can hang within reach of the baby, said non-elastic strap having a length selected such that the pacifier member hangs proximate a point just below the baby's chin, wherein said length is adapted to keep said pacifier member within the baby's reach but substantially preventing said non-elastic strap from wrapping around the baby's throat so as to prevent a strangulation hazard.

6. The kit of claim 5 wherein said fasteners are defined by selectively positioned cooperating portions of hook and loop fastener material.

7. The kit of claim 5 wherein said fasteners are defined by selectively positioned cooperating snap members.

8. A kit for accessorizing an outfit worn by an infant, said kit comprising:

a substantially rectangular cloth blanket having a selected length and a selected width, wherein said selected length is greater than said selected width, said cloth blanket having a front and a back and being adapted for wrapping around an infant, said blanket comprising a right side, a left side, and a bottom portion, wherein said left side of said blanket is adapted to be folded in front of the infant and said right side is adapted to be folded over such that said right and left side overlap in front of said infant, said blanket further including fasteners to secure said blanket in a folded position, wherein said blanket further comprises a first securement member disposed at proximate a midpoint along an inside bottom edge of said blanket and a second securement member adapted to cooperate with said first securement member and disposed at a top of said blanket on an inside left proximate the edge of said blanket whereby said bottom portion of said blanket can be folded up and secured to the upper edge of said blanket when in a folded position;

a first fastening means for securing portions of said blanket to itself disposed at an upper right inside edge of said blanket;

a second fastening means for securing portions of said blanket to itself disposed at an upper left outside edge of said blanket, said second fastening means being adapted to cooperate with said first fastening means whereby engagement of said second fastening means with said first fastening means secures said blanket in a wrapped position;

a burp cloth removably attached to a selected portion of along a bottom inside edge of said blanket by a fastener;

suspender members secured to said blanket at an upper edge of said blanket and adapted to be worn over the infant's shoulders for securing said blanket to the infant in manner that allows freedom of movement of the infant's arms;

a cap to be worn by the infant;

a single, non-elastic strap secured to a portion of said cap, said strap having a distal end; and a pacifier member carried by said distal end of said strap, wherein said non-elastic strap is adapted to secure said pacifier member to said cap such that said pacifier member can hang within reach of the baby, said non-elastic strap having a length selected such that the pacifier member hangs proximate a point just below the baby's chin, wherein said length is adapted to keep said pacifier member within the baby's reach but substantially preventing said non-elastic strap from wrapping around the baby's throat so as to prevent a strangulation hazard.

9. The kit of claim 8 wherein said first and said second fastening means for securing portions of said blanket to itself are defined by cooperating portions of hook and loop fastener material.

10. The kit of claim 8 wherein said first and said second fastening means for securing portions of said blanket to itself are defined by selectively positioned cooperating snap members.

11. The kit of claim 1 wherein said bottom portion is adapted to be folded up be folded up and secured to the upper edge of the folded blanket, wherein said blanket further comprises a first securement member disposed at proximate a midpoint along an inside bottom edge of said blanket and a second securement member adapted to cooperate with said first securement member and disposed at a top of said blanket on an inside left proximate the edge of said blanket.

* * * * *